US009586068B2

(12) United States Patent
Wiley

(10) Patent No.: US 9,586,068 B2
(45) Date of Patent: Mar. 7, 2017

(54) WILDFIRE-CONTROL-AND-CONTAINMENT SYSTEM

(71) Applicant: Michael D. Wiley, Mt. Morris, MI (US)

(72) Inventor: Michael D. Wiley, Mt. Morris, MI (US)

( * ) Notice: Subject to any disclaimer, the term of this patent is extended or adjusted under 35 U.S.C. 154(b) by 162 days.

(21) Appl. No.: 14/120,567

(22) Filed: Jun. 5, 2014

(65) Prior Publication Data

US 2015/0352384 A1 Dec. 10, 2015

(51) Int. Cl.

| | |
|---|---|
| ***A62C 3/00*** | (2006.01) |
| ***A62C 3/02*** | (2006.01) |
| ***A62C 27/00*** | (2006.01) |

(52) U.S. Cl.

CPC ..... *A62C 3/0207* (2013.01); *A62C 3/0292* (2013.01); *A62C 27/00* (2013.01)

(58) Field of Classification Search

CPC ..... A62C 3/0207; A62C 3/0292; A62C 27/00

USPC ..... 169/52; 239/14.2, 419.3, 425.5

See application file for complete search history.

(56) References Cited

U.S. PATENT DOCUMENTS

| | | | | |
|---|---|---|---|---|
| 4,573,636 | A * | 3/1986 | Dilworth | F25C 3/04 239/2.2 |
| 4,875,526 | A * | 10/1989 | Latino | A62C 27/00 169/24 |
| 5,836,398 | A * | 11/1998 | White | A62C 27/00 169/24 |
| 2007/0186778 | A1* | 8/2007 | Peterson | B01D 47/06 96/281 |
| 2007/0256842 | A1* | 11/2007 | Mohr | A62C 3/02 169/24 |
| 2010/0252284 | A1* | 10/2010 | Johansen | A62C 3/0207 169/46 |

* cited by examiner

*Primary Examiner* — Arthur O Hall
*Assistant Examiner* — Viet Le
(74) *Attorney, Agent, or Firm* — Brian S. Pickell

(57) ABSTRACT

A system for controlling and containing wildfires comprises a transport unit that is configured to transport the system to a site of a wildfire. At least one fluid-spraying apparatus is configured to spray and blow fluid at the wildfire for control and containment thereof. At least one linkage device is configured to movingly link the transport unit to a corresponding fluid-spraying apparatus. The transport unit is configured to control operation of the transport unit, linkage device, and fluid-spraying apparatus. The linkage device is configured to move with respect to the transport unit and the fluid-spraying apparatus is configured to move with respect to the linkage device such that the fluid can be sprayed multi-directionally for control and containment of the wildfire.

14 Claims, 6 Drawing Sheets

WILDFIRE-CONTROL-AND-CONTAINMENT SYSTEM

BACKGROUND OF INVENTION

1. Field of Invention

The invention relates, generally, to wildfires and, more particularly, to a system for controlling and containing them.

2. Description of Related Technology

Uncontrolled and uncontained wildfires and effects related to them cause significant damage and destruction, resulting in large and mounting costs in burned land, repair, and even lives. These wildfires and their related effects also release greenhouse gases and, thus, have even been linked to costs of global warming and a very dangerous global-environmental situation. Such costs, as well as those to try to control and contain the wildfires, are growing and unnecessary.

It is known to use elite or special chemicals, equipment, firefighters, machines, methods, and/or tools to try to extinguish or suppress wildfires. However, these means can be difficult to deliver properly to a site of a wildfire. These means can be difficult to deliver also rapidly to the site such that time to deploy them can be too long, thereby allowing the wildfires to escape out of control. They can be also dangerous, expensive, and high-risk. They can also cause destruction and even claim lives.

Thus, there is still a need for effective control and containment of wildfires. More specifically, there is a need to minimize or even prevent spread of tragic deadly wildfires and, in turn, loss of acres of land at substantial cost and lives of firefighters and others and release of greenhouse gases. There is a need also for a means of such control and containment that is not difficult to deliver properly to a site of a wildfire. There is a need also for a means of such control and containment that is not difficult to deliver also rapidly such that time to deploy it is not too long, thereby preventing the wildfires from escaping out of control. There is a need for such a means that is not also dangerous, expensive, and high-risk. There is a need for such a means that also does not cause destruction nor claim lives.

SUMMARY OF INVENTION

The invention satisfies these needs in a system for controlling and containing wildfires. The system includes a transport unit that is configured to transport the system to a site of a wildfire. At least one fluid-spraying apparatus is configured to spray and blow fluid at the wildfire for control and containment thereof. At least one linkage device is configured to movingly link the transport unit to a corresponding fluid-spraying apparatus. The transport unit is configured to control operation of the transport unit, linkage device, and fluid-spraying apparatus. The linkage device is configured to move with respect to the transport unit and the fluid-spraying apparatus is configured to move with respect to the linkage device such that the fluid can be sprayed multi-directionally for control and containment of the wildfire.

The wildfire-control-and-containment system of the invention effectively controls and contains wildfires.

The system also minimizes or even prevents spread of tragic deadly wildfires.

The system minimizes or even prevents also loss of acres of land at substantial cost.

The system minimizes or even prevents loss of also lives of firefighters and others.

The system minimizes or even prevents also release of greenhouse gases.

The system also is not difficult to deliver properly to a site of a wildfire.

The system is not difficult to deliver also rapidly to the site.

Time to deploy the system to the site is not too long.

The system prevents also wildfires from escaping out of control.

The system is not also dangerous.

The system is not also expensive.

The system is not also high-risk.

The system also does not cause destruction.

The system does not also claim lives.

Those having ordinary skill in the related technology should readily appreciate objects, features, and advantages of the wildfire-control-and-containment system of the invention as it becomes more understood while the subsequent detailed description of exemplary embodiments of the system is read taken in conjunction with an accompanying drawing thereof.

BRIEF DESCRIPTION OF EACH FIGURE OF DRAWING OF INVENTION

DETAILED DESCRIPTION OF EXEMPLARY EMBODIMENTS OF INVENTION

Figure 3:
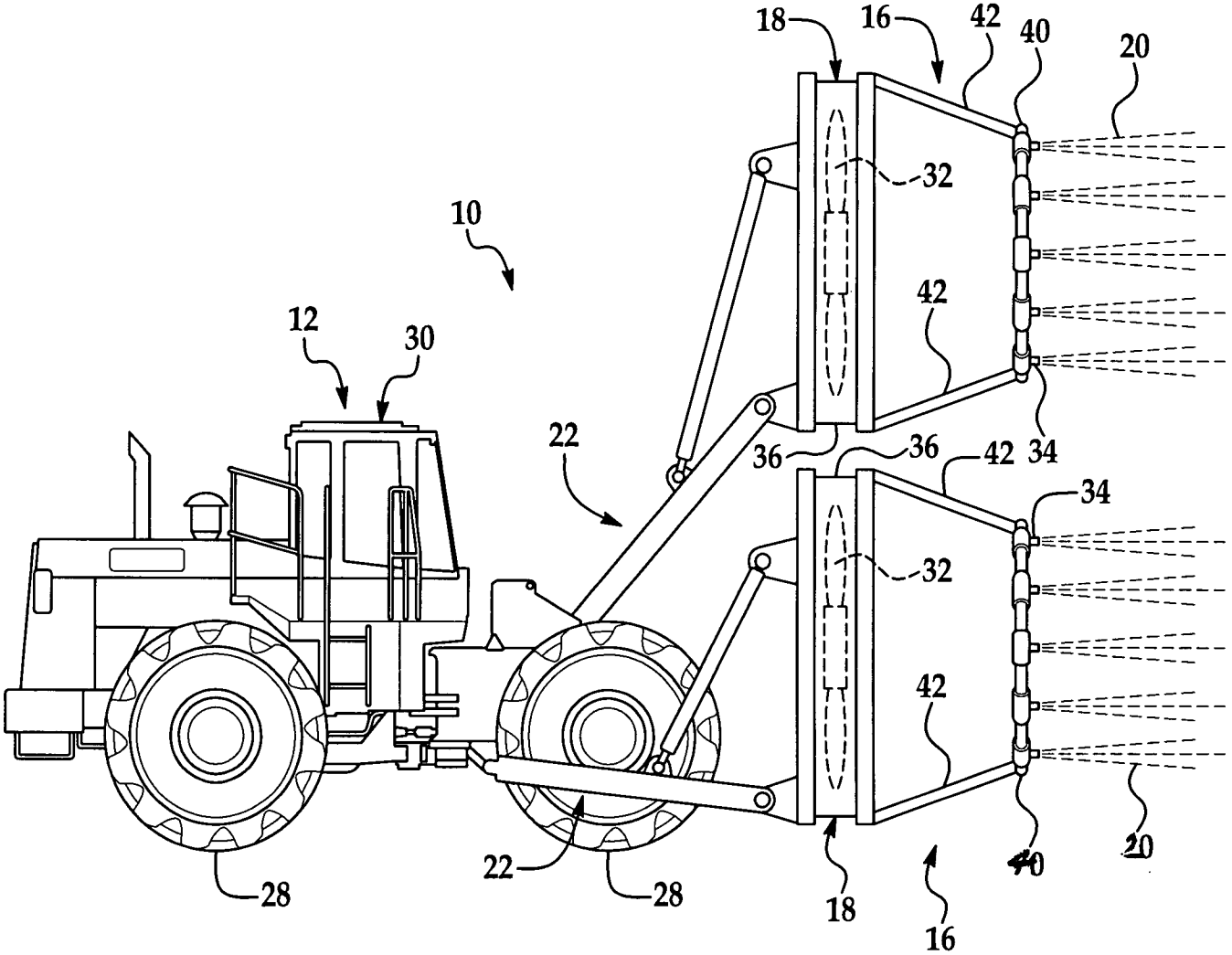
FIG. 3 is a side view of even another exemplary embodiment of the wildfire-control-and-containment system of the invention.
Figure 4:
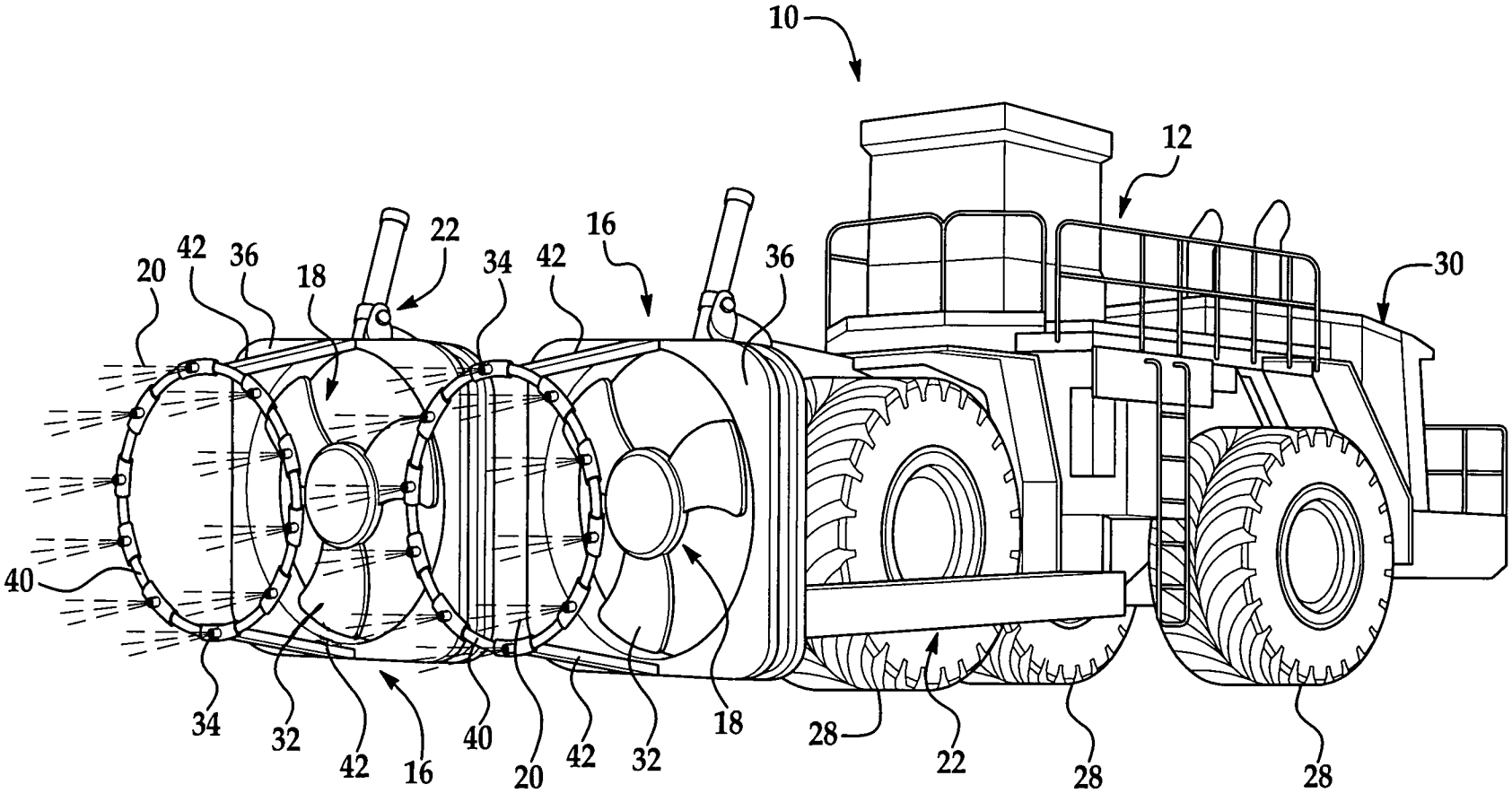
FIG. 4 is a side view of still another exemplary embodiment of the wildfire-control-and-containment system of the invention.
Figure 5:
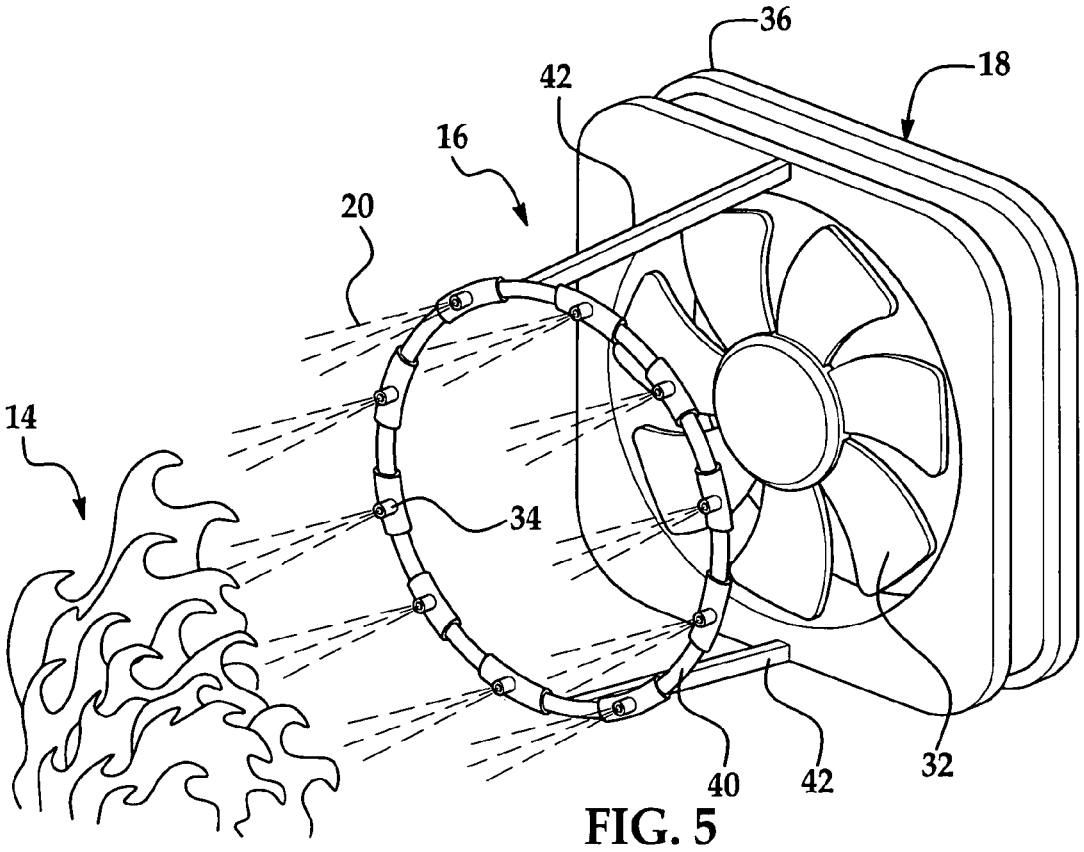
FIG. 5 is an environmental perspective view of an exemplary embodiment of an fluid-spraying apparatus of a wildfire-control-and-containment system of the invention.
Figure 6:
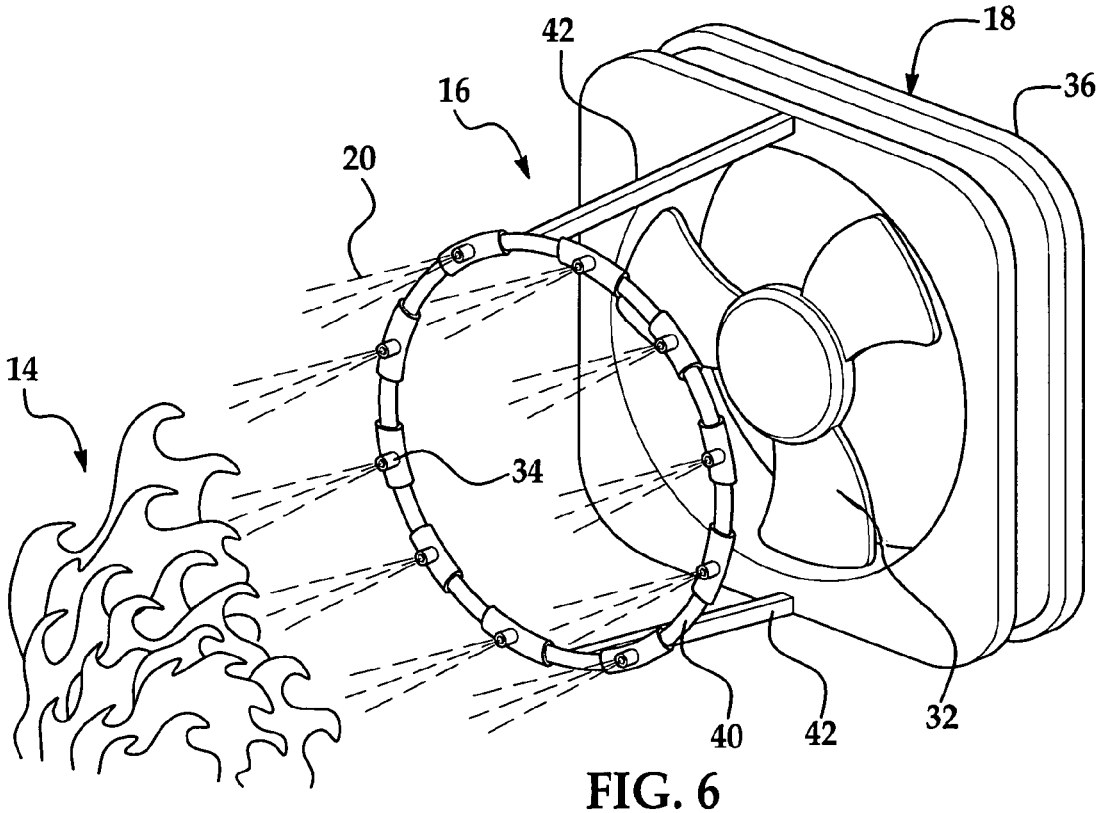
FIG. 6 is an environmental perspective view of another exemplary embodiment of the fluid-spraying apparatus of the wildfire-control-and-containment system of the invention.

Referring now to the figures, throughout which like numerals are used to designate like structure, a system for controlling and containing wildfires according to the invention, in various non-limiting exemplary embodiments thereof, is generally indicated at 10. It should be readily appreciated by those having ordinary skill in the related technology that the system 10 can be implemented in any suitable setting of a wildfire. It should be so appreciated also that, although exemplary embodiments of the system 10 are described in detail below and shown in the figures implemented in connection with wildfires, the system 10 can be implemented with any suitable type of fire:

Referring now specifically to FIGS. 1-4, the system 10 includes, in general, a transport unit, generally indicated at 12, that is configured to transport the system 10 to a site of a wildfire, generally indicated at 14 (FIGS. 5 and 6). At least one fluid-spraying apparatus, generally indicated at 16, is configured to spray and blow fluid 20 at the wildfire 14 for control and containment of the wildfire 14. At least one linkage device, generally indicated at 22, is configured to movingly link the transport unit 12 to a corresponding fluid-spraying apparatus 16. The transport unit 12 is configured to control operation of the transport unit 12, linkage device 22, and fluid-spraying apparatus 16. The linkage device 22 is configured to move with respect to the transport unit 12, and the fluid-spraying apparatus 16 is configured to move with respect to the linkage device 22 such that the fluid 20 can be sprayed multi-directionally for control and containment of the wildfire 14.

Figure 1:
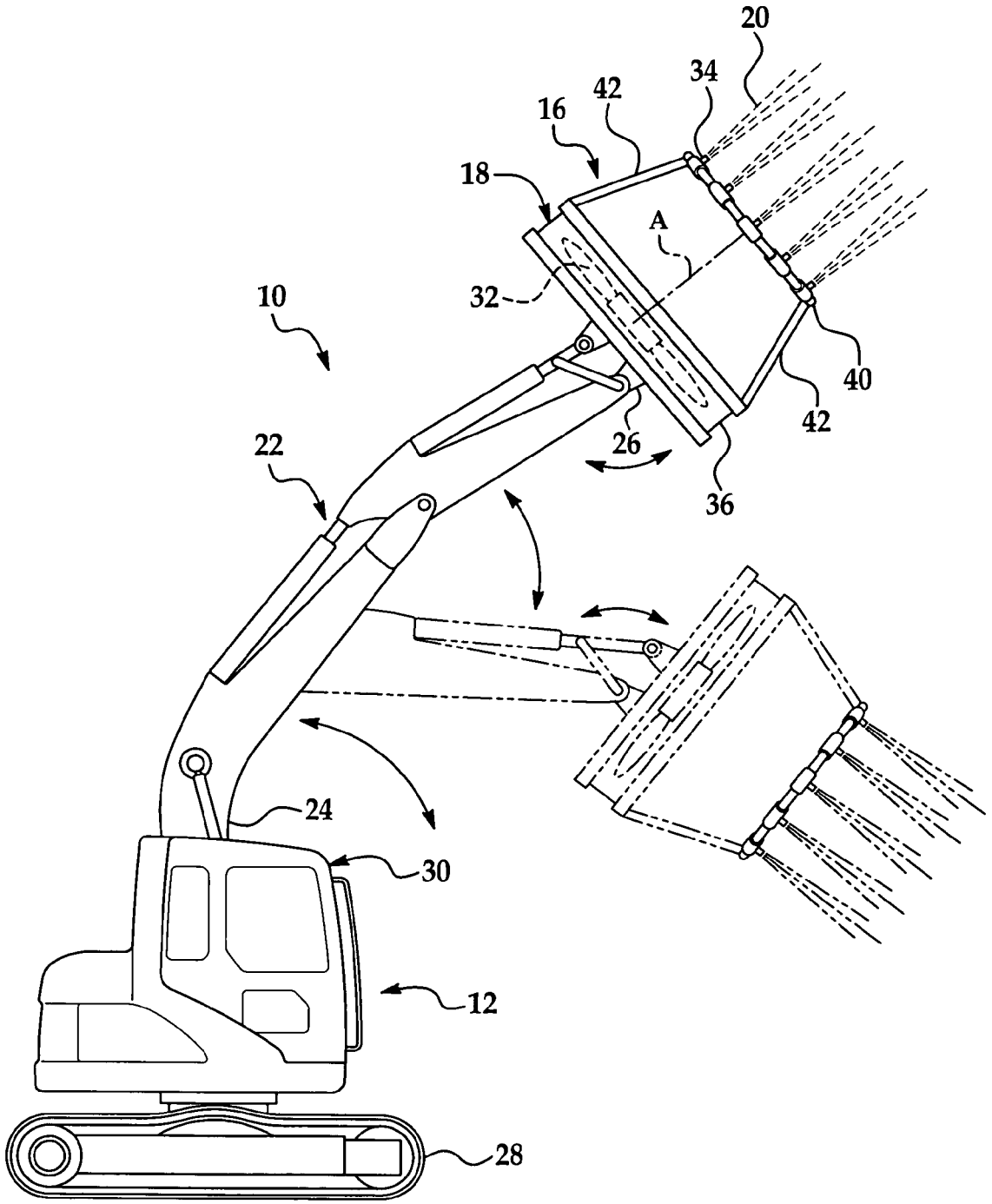
FIG. 1 is a side view of an exemplary embodiment of the wildfire-control-and-containment system of the invention.
Figure 2:
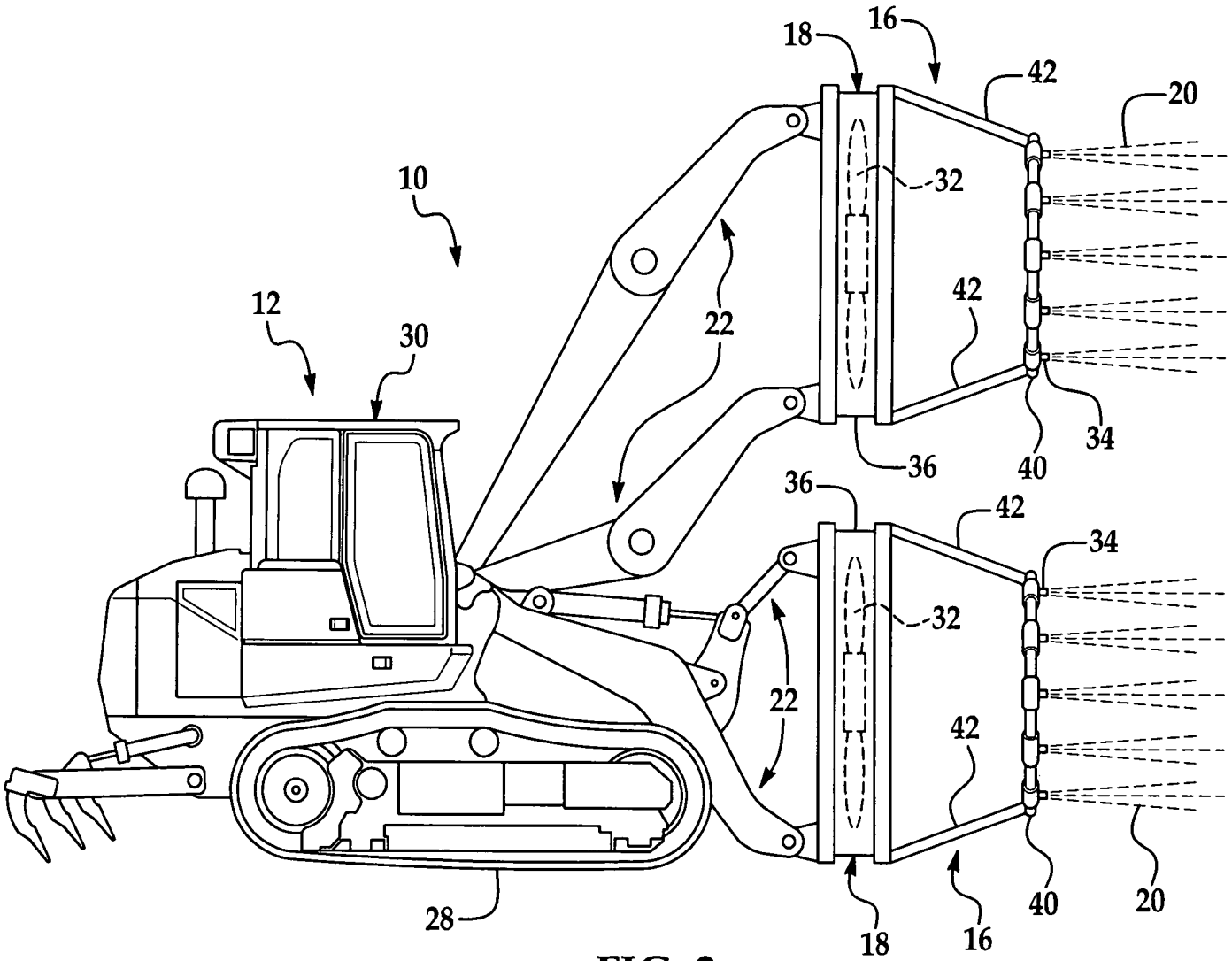
FIG. 2 is a perspective view of another exemplary embodiment of the wildfire-control-and-containment system of the invention.

More specifically, in exemplary embodiments of the system 10, the linkage device 22 defines a first end 24 (shown in FIG. 1 only) of the linkage device 22 connected to the transport unit 12 and a second end 26 (shown in FIG. 1 only) of the linkage device 22 connected to the fluid-spraying apparatus 16. As shown in FIG. 1 only, parts of the linkage device 22 are configured to move in any combination of x-, y-, and z-coordinate planes with respect to a remainder of the linkage device 22. In particular, the linkage device 22 is configured to articulatingly link the transport unit 12 to the fluid-spraying apparatus 16. As shown in FIG. 1 only, the linkage device 22 is configured to also move with respect to the transport unit 12 in any combination of x-, y-, and z-coordinate planes. In particular, the linkage device 22 is configured to swivel with respect to the transport unit 12. As shown in FIG. 1 only, the fluid-spraying apparatus 16 is configured to move with respect to the linkage device 22 in any combination of x-, y-, and z-coordinate planes as well such that the fluid 20 can be sprayed in any combination of x-, y-, and z-coordinate directions for control and containment of the wildfire 14. In particular, the fluid-spraying apparatus 16 is configured to swivel with respect to the linkage device 22. In the exemplary embodiments, the linkage device 22 is operated and powered hydraulically.

The exemplary embodiment of the system 10 shown in FIG. 1 includes only a single linkage device 22 and corresponding fluid-spraying apparatus 16 configured to link the transport unit 12 to the fluid-spraying apparatus 16. The exemplary embodiments of the system 10 shown respectively in FIGS. 2-4 include a plurality—namely, a pair—of substantially identical fluid-spraying apparatuses 16 and corresponding substantially identical linkage assemblies 22 configured to link the transport unit 12 to the fluid-spraying apparatuses 16.

It should be readily appreciated by those having ordinary skill in the related technology that the linkage device 22 can move in any suitable manner and by any suitable means and method. It should be so appreciated also that the linkage device 22 can be operatively connected to the transport unit 12 and fluid-spraying apparatus 16 by any suitable means and method. It should be so appreciated also that the linkage device 22 can move with respect to the transport unit 12 and the fluid-spraying apparatus 16 can move with respect to the linkage device 22 in any suitable manner. It should be so appreciated also that the linkage device 22 can be operated and powered hydraulically by any suitable means and method. It should be so appreciated also that the linkage device 22 can be operated and powered in any suitable manner. For instance, the linkage device 22 can be operated and powered any combination of electronically, hydraulically, mechanically, pneumatically, and/or otherwise. It should be so appreciated also that the system 10 can include any suitable number of fluid-spraying apparatuses 16 and, in turn, corresponding linkage assemblies 22.

Still referring specifically to FIGS. 1-4, the transport unit 12 is configured to be any combination of compact, controllable, durable, heavy-duty, maneuverable, powerful, productive, reliable, and/or versatile and mobilized across terrains of all types (i.e., from rough to smooth and from concrete to ice to soil). Toward that end, the transport unit 12 includes a set of wheels 28 having rubber or steel. In respective aspects, the transport unit 12 includes tracks 28 (FIGS. 1 and 2) and/or tires 28 (FIGS. 3 and 4). Respective exemplary embodiments of the transport unit 12 include a vehicle portion, generally indicated at 30, of heavy equipment—e.g., an excavator 12 (FIG. 1), a loader 12 (FIGS. 2 and 3), and a soil compactor 12 (FIG. 4). The first end 24 of the linkage device 22 is connected to the vehicle portion 30 of the transport unit 12.

The system 10 is designed such that an operator manually controls operation of the system 10 from within the transport unit 12. From this location, the operator has access to controls (e.g., buttons, levers, switches etc.) that operate corresponding sources of power and control for the system 10, in general, and the transport unit 12, linkage device 22, and fluid-spraying apparatus 16, in particular.

It should be readily appreciated by those having ordinary skill in the related technology that the transport unit 12 can include any suitable means of transport. By way of example only and not by way of limitation, the transport unit 12 can include a vehicle portion 30 of any suitable type of heavy equipment—such as a back hoe—or any suitable type of heavy-duty vehicle—such as a semi-trailer. It should be so appreciated also that the transport unit 12 can control operation of the transport unit 12, linkage device 22, and fluid-spraying apparatus 16 in any suitable manner. It should be so appreciated also that the system 10 can be mobilized across terrains of all types in any suitable manner and by any suitable means and method. It should be so appreciated also that the transport unit 12 can include any suitable number of wheels 28 (e.g., tracks 28 and/or tires 28) and the wheels 28 can be made of any suitable material. It should be so appreciated also that operation of the system 10 (including sources of power and control for the system 10) can be controlled in any suitable manner, by any suitable means and method, and from any suitable location.

Referring now specifically to FIGS. 4-7, the fluid-spraying apparatus 16 includes a blower, generally indicated at 18, that is configured to blow the sprayed fluid 20 at the wildfire 14 and disperse the fluid 20 over a large area of the wildfire 14. In respective embodiments illustrated in the figures, the blower 18 is a fan assembly 18 having at least one blade 32 (in particular, a plurality of blades 32). A diameter of coverage of rotation of the blades 32 can be, say, approximately eighty-two inches, and each of the blades 32 can be made of, say, carbon fiber. In an exemplary embodiment of the fluid-spraying apparatus 16 shown in FIG. 5, the fan assembly 18 includes seven substantially identical blades 32 whereas, in respective exemplary' embodiments of the fluid-spraying apparatus 16 shown in FIGS. 4, 6, and 7, the fan assembly 18 includes three substantially identical blades 32.

It should be readily appreciated by those having ordinary skill in the related technology that the blower 18 can be any suitable machine or mechanism configured to blow the sprayed fluid 20 at and disperse the fluid 20 over a large area of the wildfire 14. It should be so appreciated also that the fan assembly 18 can be any suitable fan. It should be so appreciated also that the fan assembly 18 can include any suitable number of blades 32. It should be so appreciated also that each of the blades 32 can have any suitable shape, size, and structure and be made of any suitable material. It should be so appreciated also that the blades 32 can have any suitable relationship with each other.

The fluid-spraying apparatus 16 includes, along with the fan assembly 18, at leak one high-pressure valve 34 (in particular, a plurality of valves 34) out of which the fluid 20 is streamed (in particular, high-power streamed) toward the wildfire 14. In FIGS. 4-6, each of the fluid-spraying apparatuses 16 is shown including ten substantially identical valves 34 whereas, in FIG. 7, the fluid-spraying apparatus 16 is shown including twelve substantially identical valves 34. Each of the valves 34 defines a diameter of the valve 34 of, say, approximately two inches and is made of, say, galvanized pipe.

It should be readily appreciated by those having ordinary skill in the related technology that the fluid-spraying apparatus 16 can include any suitable number of valves 34. It should be so appreciated also that each of the valves 34 can have any suitable shape, size, and structure and be made of any suitable material. It should be so appreciated also that the valves 34 can have any suitable relationship with each other.

Still referring specifically to FIGS. 4-7, the blades 32 are disposed and configured to rotate within a housing 36 (FIGS. 4-6) or short cylinder, generally indicated at 38 (FIG. 7), of the fan assembly 18. The blades 32 are disposed substantially concentrically and symmetrically with respect to the housing 36 or cylinder 38.

It should be readily appreciated by those having ordinary skill in the related technology that the blades 32 rotate at any suitable speed. It should be so appreciated also that the blades 32 can have any suitable relationship with the housing 36 or cylinder 38. It should be so appreciated also that each of the housing 36 and cylinder 38 can have any suitable shape, size, and structure. It should be so appreciated also that the fan assembly 18 may not include the housing 36 or cylinder 38. It should be so appreciated also that the fan assembly 18 can have any suitable relationship with a remainder of the fluid-spraying apparatus 16.

The valves 34 are disposed substantially uniformly along a ring 40 of the corresponding fluid-spraying apparatus 16. A set of separators 42 (namely, a pair of substantially identical, opposed, linear separators 42 shown FIGS. 4-6) is connected to and extends between a periphery of an inner face of the housing 36 and an inner side of the ring 40 to define a desired distance of space between the blades 32 and valves 34. The separators 42 are shown disposed slightly tapered from the housing 36 to the ring 40. Alternatively, the ring 40 is disposed substantially concentrically on a substantially central area of an outer face 44 of the cylinder 38 (FIG. 7) to define a desired distance of space between the blades 32 and valves 34, depending upon a length of the cylinder 38. The distance between the blades 32 and valves 34 shown in FIGS. 4-6 is greater than that shown in FIG. 7.

In FIGS. 4-7, the blades 32 and valves 34 are shown spaced from each other. More specifically, the blades 32, housing 36 or cylinder 38, and ring 40 are disposed substantially parallel with each other, and the valves 34, separators 42, and an axis "A" (shown in FIG. 1 only) of the fan assembly 18 are disposed substantially parallel with each other and perpendicular to the blades 32, housing 36 or cylinder 38, and ring 40. The axis "A" is substantially concentric with the blades 32, housing 36 or cylinder 38, and ring 40. In FIGS. 4-6, the diameter of coverage of rotation of the blades 32 is shown substantially equal to a diameter of the ring 40 such that the blades 32 and valves 34 are substantially aligned with each other (i.e., the ring 40 lies substantially at a periphery of or within a projection of the blades 32 at the ring 40). Yet, in FIG. 7, the diameter of coverage of rotation of the blades 32 is shown less than the diameter of the ring 40 such that the blades 32 and valves 34 are not substantially aligned with each other (i.e., the ring 40 lies outside the projection of the blades 32 at the ring 40). In either event, in FIGS. 4-7, the valves 34 are shown positioned between the blades 32 and wildfire 14. Those having ordinary skill in the related technology should readily appreciate, however, that the respective positions of the blades 32 and valves 34 can be reversed such that the blades 32 can be positioned between the valves 34 and wildfire 14.

It should be readily appreciated by those having ordinary skill in the related technology that the valves 34 can have any suitable relationship with the ring 40. It should be so appreciated also that each of the ring 40 and separators 42 can have any suitable shape, size, and structure. It should be so appreciated also that the fluid-spraying apparatus 16 can include any suitable number of separators 42. It should be so appreciated also that the separators 42 can be connected to the housing 36 and ring 40 in any suitable manner. It should be so appreciated also that the space between the blades 32 and valves 34 can be any suitable distance. It should be so appreciated also that the fluid-spraying apparatus 16 may not include the separators 42. It should be so appreciated also that the ring 40 and separators 42 or cylinder 38 can have any suitable relationship with each other and a remainder of the fluid-spraying apparatus 16.

The blades 32 rotate about the axis "A" such that the rotating blades 32 blow air that is positioned proximate the fan assembly 18 away from the fan assembly 18 and toward the ring 40. The valves 34 stream the fluid 20 in a direction away from the fan assembly 18 and toward the wildfire 14 as the blown air from the fan assembly 18 assists in blowing the streamed fluid 20 toward the wildfire 14. Although each of the streams is substantially linear and the streams are substantially uniform and parallel with respect to each other immediately upon their exit from the respective valves 34, the rotating blades 32 assist in dispersing the streamed fluid 20 at and over a large area of the wildfire 14. The fluid-spraying apparatus 16 is designed to spray the fluid 20, say, from about five-hundred to about seven-hundred-and-fifty feet.

It should be readily appreciated by those having ordinary skill in the related technology that the streams can have any suitable trajectory immediately upon their exit from the respective valves 34. It should be so appreciated also that the valves 34 can stream the fluid 20 at any suitable force, power, speed, etc. It should be so appreciated also that the fluid-spraying apparatus 16 can be designed to spray the fluid 20 any suitable distance.

The fluid 20 can be used for extinguishing the wildfire 14 or increasing size and/or intensity of the wildfire 14 (which increase can actually be temporarily desired under certain exceptional circumstances and conditions for controlling and containing the wildfire 14 prior to spraying of extinguishant on the wildfire 14). As such, the fluid 20 can include air, water, fuel, and/or other chemical. In particular, the fuel can include gasoline, oil, or a mixture thereof, and the other chemical can include flame retardant, foam, at least one fire ball, and/or other extinguishant. It should be readily appreciated by those having ordinary skill in the related technology that the fluid 20 can include any suitable types of air and liquid.

Figure 7:
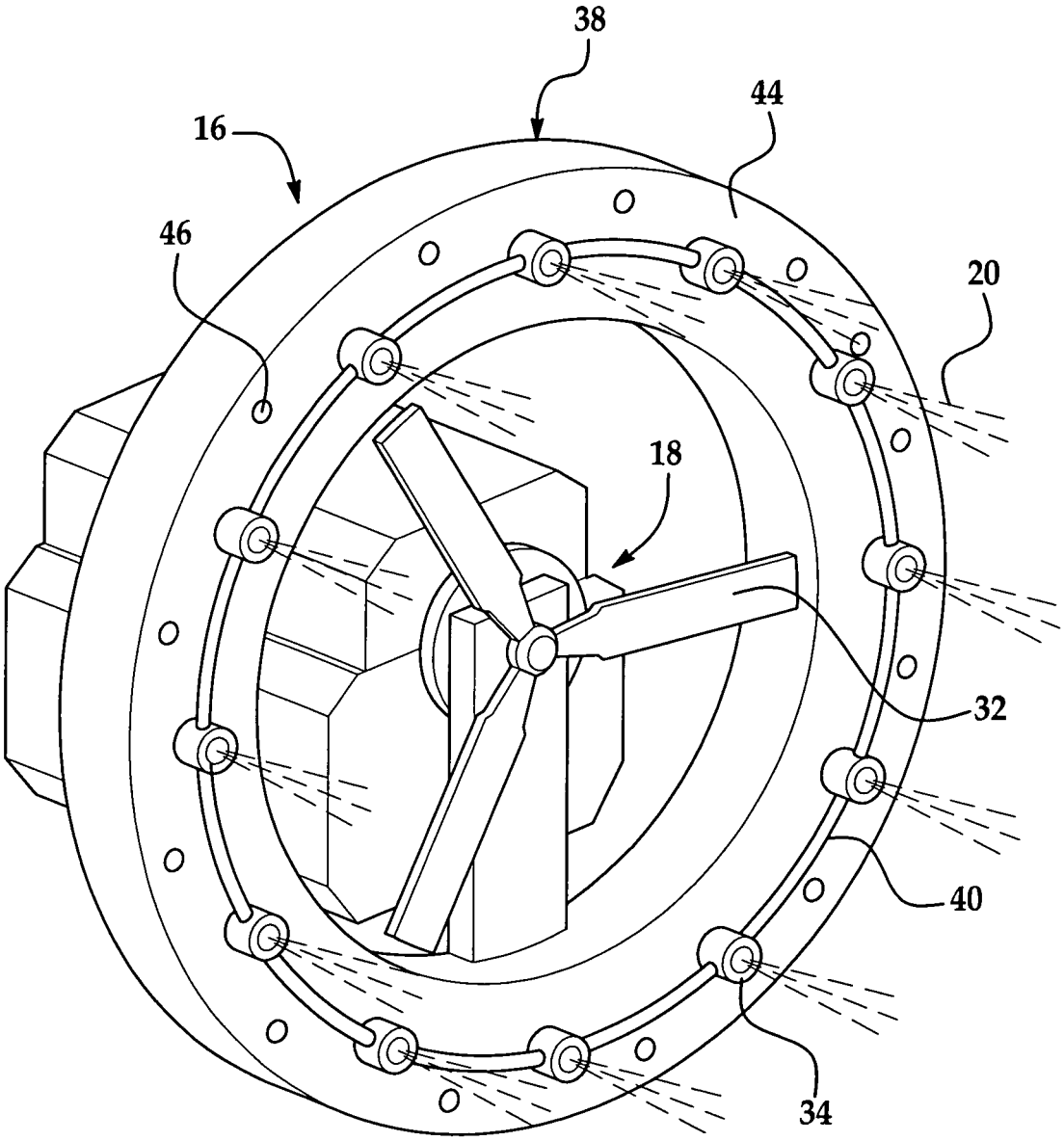
FIG. 7 is a perspective view of still another exemplary embodiment of the fluid-spraying apparatus of the wildfire-control-and-containment system of the invention.

Further in this regard, an exemplary embodiment of the fluid-spraying apparatus 16 illustrated in FIG. 7 defines at least one high-pressure outlet 46 (in particular, a plurality of outlets 46) out of which some of the fluid 20 is streamed (in particular, high-power streamed) toward the wildfire 14 such that a remainder of the fluid 20 is streamed out of the valves 34 toward the wildfire 14. More specifically, the outer face 44 of the cylinder 38 defines the outlets 46. For instance, water can be streamed from the valves 34 while fuel and/or other chemical can be streamed from the outlets 46. However, all of the fluid 20 can be streamed from either the valves 34 or outlets 46 (and from only some of the valves 34 and/or outlets 46 at that). In FIG. 7, the fluid-spraying apparatus 16 is shown including twelve substantially identical outlets 46. The outlets 46 are disposed substantially uniformly along a perimeter of the outer face 44 such that each of the outlets 46 lies outside the ring 40 and is positioned substantially equidistant to the two nearest valves 34. Each of the outlets 46 defines a diameter of the outlet 46 of, say, approximately three-quarters inch and is made of, say, galvanized pipe. In FIG. 7, whereas the valves 34 are shown raised, the outlets 46 are shown substantially flush with the outer face 44 of the cylinder 38.

It should be readily appreciated by those having ordinary skill in the related technology that any type of fluid 20 can be streamed from the outlets 46 in any suitable manner. It should be so appreciated also that the fluid-spraying apparatus 16 can include any suitable number of outlets 46. It should be so appreciated also that each of the outlets 46 can have any suitable shape, size, and structure and be made of any suitable material. It should be so appreciated also that the outlets 46 can have any suitable relationship with each other and the valves 34 and cylinder 38.

The system 10 can include at least one source (in particular, a plurality of sources) of flood light (not shown). The system 10 can include also compressed-air-, water-, fuel-, and/or other-chemical-storage tanks (not shown). It should be readily appreciated by those having ordinary skill in the related technology that each of the flood-light sources and storage tanks can have any suitable shape, size, structure, relationship with a remainder of the system 10, and location on the system 10. Alternatively, the system 10 can be configured to pull or transport in any suitable manner and by any suitable means or method a tanker that stores the compressed air, water, fuel, and/or other chemical. The system 10 can include any suitable types of emergency-communications equipment as well.

An operator of the system 10 is stationed inside the transport unit 12 and manually controls operation of the system 10. The system 10 is delivered or deployed to a site of a wildfire 14. Toward that end, the operator transports the system 10 over practically any type of terrain and/or water to the site. Upon arrival of the system 10 at the site, the operator controls angular, linear, and rotational displacement and position of the linkage device 22 with respect to the transport unit 12 and angular, linear, and rotational displacement and position of the fluid-spraying apparatus 16 with respect to the corresponding linkage device 22. This control allows not only great range of motion of the fluid-spraying apparatus 16 toward and away from and up, down, left, and right relative to the wildfire 14, but also accurate and precise angle of direction of the fluid-spraying apparatus 16 relative to the wildfire 14. In this way, the fluid-spraying apparatus 16 is positioned at an optimal distance from and angle with respect to the wildfire 14.

For control and containment of the wildfire 14, the operator then controls activation/deactivation of the fan assembly 18, valves 34, and/or outlets 46 and speed of the fan assembly 18 and amount of power generated by the stream of the fluid 20 through the valves 34 and/or outlets 46. The operator controls also amount, kind, and mix of the fluid 20 to be sprayed (blown and streamed) at the wildfire 14 by the fan assembly 18 through the valves 34 and/or outlets 46. In this regard, the system 10 can automatically or via the operator tap into the storage tanks of the system 10 and/or the tanker that the system 10 pulled or transported to the site. The operator also can, as required, continually change position of the fluid-spraying apparatus 16 and, thus, direction of the streaming of the fluid 20 with respect to the wildfire 14 until the wildfire 14 is sufficiently controlled and contained. The operator can also use the flood light when circumstances and conditions at the site require such light. At any time, the operator can use also the emergency-communications equipment of the system 10.

It should be readily appreciated by those having ordinary skill in the related technology that the system 10, in general, and each of the transport unit 12, fluid-spraying apparatus 16, and corresponding linkage device 22, in particular, can have any suitable shape, size, and structure. It should be so appreciated also that the transport unit 12, fluid-spraying apparatus 16, and corresponding linkage device 22 can have any suitable relationship with each other. It should be so appreciated also that each of the transport unit 12, fluid-spraying apparatus 16, and corresponding linkage device 22 can be made of any suitable material.

The system 10 effectively controls and contains wildfires 14. Also, the system 10 minimizes or even prevents spread of tragic deadly wildfires 14, loss of acres of land at substantial cost, lives of firefighters and others, and release of greenhouse gases. And, the system 10 is not difficult to deliver properly to a site of a wildfire 14 and rapidly to the site. Furthermore, time to deploy the system 10 to the site is not too long. In addition, the system 10 prevents wildfires 14 from escaping out of control. Moreover, the system 10 is not dangerous, expensive, or high-risk. Plus, the system 10 does not cause destruction or claim lives.

The system 10 has been described above in an illustrative manner. Those having ordinary skill in the related technology should readily appreciate that the terminology that has been used above is intended to be in the nature of words of description rather than of limitation. Many modifications and variations of the system 10 are possible in light of the above teachings. Therefore, within the scope of the claims appended hereto, the system 10 may be practiced other than as so described.

What is claimed is:

1. A system for controlling and containing wildfires comprises:

a transport unit that is configured to transport the system to a site of a wildfire;

at least one primary fluid for increasing size and intensity of a first part of the wildfire and at least one secondary fluid for extinguishing the first part and a second part of the wildfire, the first part of the wildfire combining with and controlling and containing the second part of the wildfire prior to spraying of the secondary fluid on the wildfire;

at least one fluid-spraying apparatus that is configured to spray and blow the fluids at the wildfire for control and containment thereof and includes at least one high-pressure valve out of which the fluids are streamed toward the wildfire, a blower that is configured to stream air positioned proximate the blower toward the valve and blow the sprayed fluids at the wildfire to disperse the fluids over a large area of the wildfire, and a set of linear separators connected to and extending between the blower and valve to define a desired distance of space between the blower and valve and separated from each other to define a respective inlet between adjacent ones of the separators for air surrounding the fluid-spraying apparatus to be entrained along the air stream of the blower; and at least one linkage device that is configured to movingly link the transport unit to a corresponding fluid-spraying apparatus, wherein the transport unit is configured to control operation of the transport unit, linkage device, and fluid-spraying apparatus, the linkage device is configured to move with respect to the transport unit, and the fluid-spraying apparatus is configured to move with respect to the linkage device such that the fluids can be sprayed multi-directionally for control and containment of the wildfire.

2. The wildfire-control-and-containment system of claim 1, wherein the linkage device defines a first end of the linkage device connected to the transport unit and a second end of the linkage device connected to the fluid-spraying apparatus.

3. The wildfire-control-and-containment system of claim 1, wherein the linkage device is configured to articulatingly link the transport unit to the fluid-spraying apparatus.

4. The wildfire-control-and-containment system of claim 1, wherein the linkage device is configured to swivel with respect to the transport unit.

5. The wildfire-control-and-containment system of claim 1, wherein the system comprises a plurality of fluid-spraying apparatuses and corresponding linkage assemblies configured to link the transport unit to the fluid-spraying apparatuses.

6. The wildfire-control-and-containment system of claim 1, wherein the transport unit includes either of a vehicle portion of heavy equipment and a heavy-duty vehicle.

7. The wildfire-control-and-containment system of claim 6, wherein the heavy equipment includes any of a back hoe, excavator, loader, and soil compactor and the heavy-duty vehicle includes a semi-trailer.

8. The wildfire-control-and-containment system of claim 1, wherein the transport unit includes a set of wheels having either of rubber and steel.

9. The wildfire-control-and-containment system of claim 1, wherein the transport unit includes a set of wheels being either of tracks and tires.

10. The wildfire-control-and-containment system of claim 1, wherein the blower is a fan assembly having at least one blade.

11. The wildfire-control-and-containment system of claim 1, wherein the blower and valve are substantially aligned with each other.

12. The wildfire-control-and-containment system of claim 1, wherein the blower and valve are spaced from and not aligned with each other.

13. The wildfire-control-and-containment system of claim 1, wherein the valve is positioned between the blower and wildfire.

14. The wildfire-control-and-containment system of claim 1, wherein the fluid-spraying apparatus defines at least one outlet out of which some of the fluid is streamed toward the wildfire such that a remainder of the fluid is streamed out of the valve toward the wildfire.

* * * * *